US006383635B1

(12) United States Patent
King et al.

(10) Patent No.: US 6,383,635 B1
(45) Date of Patent: May 7, 2002

(54) MELT SPINNING COLORED POLYCONDENSATION POLYMERS

(75) Inventors: Charles Melvin King; Christopher Waddell Goff; William Timothy Albright, all of Charlotte, NC (US)

(73) Assignee: Wellman, Inc., Shrewbury, NJ (US)

( * ) Notice: Subject to any disclaimer, the term of this patent is extended or adjusted under 35 U.S.C. 154(b) by 0 days.

(21) Appl. No.: 09/386,812

(22) Filed: Aug. 31, 1999

(51) Int. Cl.[7] ..... B32B 27/34; B32B 27/36; B32B 9/00; D02G 3/00

(52) U.S. Cl. ..... 428/395; 428/364; 428/365; 428/392; 428/480

(58) Field of Search ..... 428/364, 365, 428/392, 395, 480

(56) References Cited

U.S. PATENT DOCUMENTS

| | | | | |
|---|---|---|---|---|
| 3,160,600 | A | 12/1964 | Holsten et al. | |
| 3,666,713 | A | 5/1972 | Wear | |
| 3,879,341 | A | 4/1975 | Barkey et al. | |
| 3,923,726 | A | 12/1975 | Benz | |
| 3,969,312 | A | 7/1976 | Lees | |
| 4,016,132 | A | 4/1977 | Lees | |
| 4,167,503 | A | 9/1979 | Cipriani | |
| 4,208,318 | A | 6/1980 | Ono et al. | |
| 4,264,326 | A | 4/1981 | Rau | |
| 4,443,573 | A | 4/1984 | Wells et al. | |
| 4,802,886 | A | 2/1989 | Boocock | |
| 4,842,781 | A | 6/1989 | Nishizawa et al. | |
| 5,057,369 | A | 10/1991 | Yamaguchi et al. | |
| 5,106,905 | A * | 4/1992 | Oku et al. | 524/604 |
| 5,194,090 | A | 3/1993 | Tajiri et al. | |
| 5,308,935 | A | 5/1994 | Burditt et al. | |
| 5,389,327 | A | 2/1995 | Longhi | |
| 5,782,935 | A * | 7/1998 | Hirt et al. | 8/512 |
| 5,833,893 | A | 11/1998 | Jones et al. | |
| 5,834,089 | A * | 11/1998 | Jones et al. | 428/97 |
| 6,110,405 | A * | 8/2000 | King et al. | 264/78 |

FOREIGN PATENT DOCUMENTS

| | | |
|---|---|---|
| EP | 266754 A2 | 5/1988 |
| EP | 0794222 A2 | 9/1997 |
| GB | 1233452 | 5/1991 |

OTHER PUBLICATIONS

Anonymous, "Colorantes y Aditivos," Internet, Dec. 17, 1998, XP002088362, URL:http://www.plastecusa.com/coloramt.htm.

Abstract of Japan 58–149,311 (Published Sep. 5, 1983).

* cited by examiner

*Primary Examiner*—Terrel Morris
*Assistant Examiner*—Norca L. Torres
(74) *Attorney, Agent, or Firm*—Summa & Allan, P.A.

(57) ABSTRACT

The invention is a method of coloring melt spun condensation polymers while avoiding hydrolytic degradation and maintaining the melt viscosity of the polymer. The method comprises adding a liquid dispersion of a colorant to the melt phase of a condensation polymer, and in-which the amount and type of the liquid in the dispersion will not substantially affect the melt viscosity of the condensation polymer; and thereafter spinning the colored melt phase condensation polymer into filament form. In another aspect the invention is a polyester filament comprising polyethylene terephthalate, a colorant, and a nonaqueous organic liquid that is soluble in melt phase polyester, and has a boiling point above 300° C., but that otherwise does not modify the polymer chain.

12 Claims, 4 Drawing Sheets

MELT SPINNING COLORED POLYCONDENSATION POLYMERS

FIELD OF THE INVENTION

The present invention relates to methods of coloring synthetic polymer filament to form respective colored yarns and fabrics, and in particular relates to a method of melt spinning polycondensation polymers that are colored using liquid colored dispersions, and to the resulting colored polymer filament, yarns and fabrics.

BACKGROUND OF THE INVENTION

Synthetic fibers are used in a wide variety of textile applications including clothing and other fabric items which, although desirably white or natural in color in many circumstances, are also desirably manufactured and marketed in a variety of colors and patterns in other circumstances.

As known to those familiar with the textile arts, several techniques are used to add color to textile products. In general, these techniques add such color to the basic structures of textile products: fibers, yarns made from fibers, and fabrics made from yarns. Thus, certain techniques dye individual fibers before they are formed into yarns, other techniques dye yarns before they are formed into fabrics, and yet other techniques dye woven or knitted fabrics.

Particular advantages and disadvantages are associated with the choice of each coloring technique. Some exemplary definitions and explanations about dyes and coloring techniques are set forth in the *Dictionary of Fiber & Textile Technology* (1990), published by Hoechst-Celanese Corporation, on pages 50–54.

Although the term "dye" is often used in a generic sense, those familiar with textile processes recognize that the term "dye" most properly describes a colorant that is soluble in the material being colored, and that the term "pigment" should be used to describe insoluble colorants.

Because polyester, particularly polyethelene terephthalate ("PET"), is so widely used in textile applications, a correspondingly wide set of needs exist to dye polyester as filament, yarn, or fabric. Although coloring yarns and fabrics are advantageous or desirable under some circumstances, coloring the initial fiber offers certain performance benefits such as improved fastness. As an additional and increasingly important consideration, coloring filament rather than yarns and fabrics tends to reduce secondary effects that must be dealt with to prevent air and water pollution that would otherwise be associated with various coloring processes.

Conventionally, a "masterbatch" approach has been used to color fibers (or filaments) during the melt spinning process. As known to those familiar with this technique, in the masterbatch process, the desired colorant is dispersed at a relatively highly concentrated level within a carrier polymer. In a following process step, the masterbatch of highly concentrated colored polymer is introduced to the melt spinning system of the polymer and blended with virgin polymer at a ratio that hopefully achieves the desired color.

Condensation polymers, however, offer particular challenges to the masterbatch system. As is known to those familiar with chemical reactions, a condensation polymer results from a reaction in which two monomers or oligomers react to form a polymer and water molecule. Because such reactions produce water, they are referred to as "condensation" reactions. Because of chemical equilibrium, however, the water must be continually removed from the polycondensation reaction, otherwise it tends to drive the reaction in the other direction; i.e. depolymerize the polymer. This results in a loss of molecular weight in the polymer which is referred to as hydrolytic degradation. In particular the molecular weight (measured by the intrinsic viscosity or "IV") of polyester can easily be decreased by as much as 0.15 dl/g (0.55–0.75 dl/g is considered a good viscosity for filament). As a greater problem—and one that becomes evident during later processing of filament and yarn—the loss in IV is quite variable depending upon the quality of process control of the masterbatch drying and extrusion systems. In particular, obtaining the required color specification of the masterbatch chip sometimes requires re-extruding the polymer to obtain a desired color correction. Unfortunately, such re-extrusion for color matching purposes tends to increase the loss in molecular weight even further.

Masterbatch "chip" is generally introduced into the spinning process using several options each of which tends to provide an extra source of variation for the resulting molecular weight. Because there are several process steps during which molecular weight can be lost, the effect tends to be cumulative and significant. The overall effect is a significant reduction in the molecular weight of the filament that manifests itself as an orientation variability in the resulting yarn. In turn, the orientation variability produces a resulting variability in the physical properties of the yarn such as elongation, tenacity, and draw force.

Such variability in the physical properties of spun yarn generates several additional problems. For example, partially oriented yarn (POY) which is draw textured must exhibit uniform draw force to assure that its pre-aggregate tension stays within desired specifications. If the yarn properties are outside of such specifications, various problems such as twist surging occur and prevent processing the yarn at commercial speeds. Furthermore, the drawing performance of spun yarns, whether POY, low orientation yarns (LOY), fully oriented yarns (FOY), or staple, is highly dependent upon consistent elongation because the imposed draw ratio cannot exceed the inherent drawability of the spun yarn (as measured by the elongation). Additionally, consistent physical properties of the final drawn or draw textured filament are desirable for optimum performance of fabrics and other end-use products.

In a practical sense, the variation in physical properties from filament to filament, fiber to fiber, and yarn to yarn forces the various textile manufacturing processes and machinery to be continually readjusted whenever a new colored fiber or yarn is introduced. Thus, the problems inherent in masterbatch coloring tend to raise the cost and lower the productivity of later textile processes that incorporate masterbatch colored fibers and yarns.

OBJECT AND SUMMARY OF THE INVENTION

Therefore, it is an object of the present invention to provide a method for adding colorant to polyester and other condensation polymers while they are in the melt phase but without adversely reducing the molecular weight and resulting properties in the manner in which they are reduced by conventional processes.

The invention meets this object with a method of coloring melt-spun condensation polymers while avoiding hydrolytic degradation and maintaining the melt viscosity of the polymer. The method comprises adding a liquid dispersion of a colorant to the melt phase of a condensation polymer and in which the amount and type of the liquid in the dispersion will not substantially effect the melt viscosity of the condensation polymer, and thereafter spinning the colored melt phase condensation polymer into filament form.

BRIEF DESCRIPTION OF THE DRAWINGS

The foregoing and other objects and advantages of the invention will become more apparent when taken in conjunction with the detailed description and accompanying drawings in which.

DETAILED DESCRIPTION

The present invention is a method of coloring a melt-spun condensation polymer while avoiding the hydrolytic degradation and maintaining the melt viscosity of the polymer, and represents a significant improvement over conventional masterbatch processes. Such processes are schematically illustrated in FIGS. 1 and 2.

Figure 1:
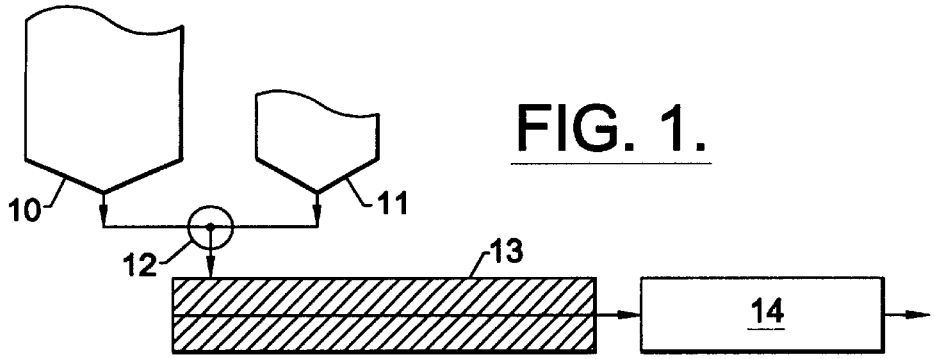
FIG. 1 is a schematic diagram of a conventional masterbatch process for producing masterbatch clip.

FIG. 1 schematically illustrates the manufacture of the masterbatch chip. Chip from a dryer 10 and pigments or dyes from a hopper or other source 11 are added in a desired blend using an appropriate blender 12 or similar device to an extruder 13 which is conventionally a single or twin screw extruder. The source chips from the dryer 10 are the same as the polymer from which the eventual filament is to be made. Thus, polyester chips are used to form the masterbatch for polyester filaments and nylon 6 or nylon 66 chips are used as the masterbatch chips for those polymers. As noted in the background, the coloring source, whether pigment, dye or something else, is typically mixed with polymer chip in a fairly high proportion to form a relatively high color concentration. The polymer that is extruded is then quenched and pelletized in appropriate equipment designated at 14 to produce a masterbatch chip which is concentrated with the pigment or dye in amounts of between about 10 and 50% by weight.

Figure 2:
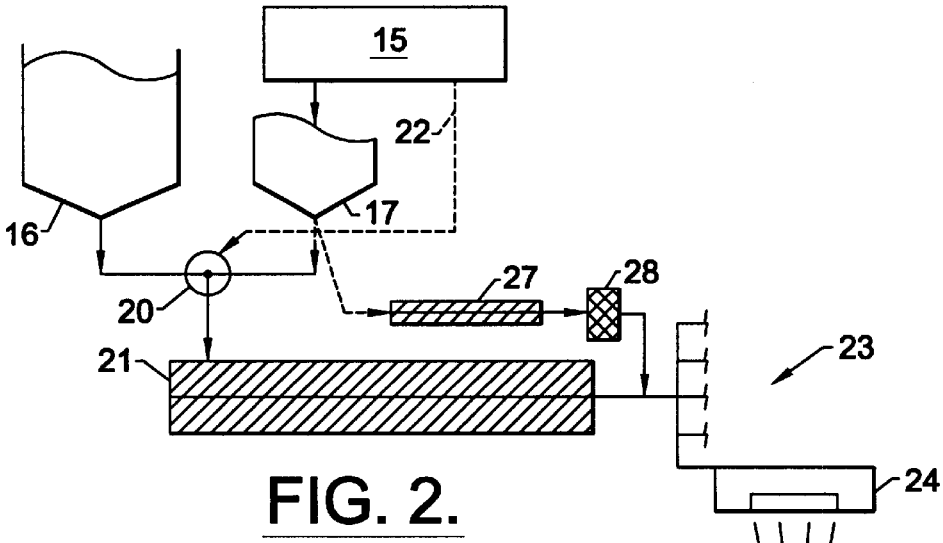
FIG. 2 is another conventional method of using a masterbatch process to produce colored filament.

FIG. 2 illustrates the manner in which the masterbatch chip is added to virgin polymer to form the final colored filament. The masterbatch chip produced in FIG. 1 is designated at 15 in FIG. 2 and is typically distributed from a dryer 17. The "base" polymer chip is distributed from another dryer 16 from which it is blended from the masterbatch chip. Several options exist for blending the masterbatch chip with the base chip. In the first option, the masterbatch chip 15 is sent to a dryer 17 from which it is blended in an appropriate mixing device 20 with the base chip and then sent to the extruder 21. As indicated by the dotted line 22, in an alternative method, the masterbatch chip 15 is mixed directly with the base chip and bypasses the dryer 17. In either of these options, the masterbatch chip and the base chip are mixed in the extruder from which they proceed to a manifold system broadly designated at 23 and then to an appropriate block, pack and spinnerette designated together at 24, from which the polymer is spun into filaments 25 and then forwarded to an appropriate take-up system 26.

Alternatively, the masterbatch chip from the dryer 17 can be forwarded to a side stream extruder 27 and thereafter pumped by the pump 28 to be mixed with the base polymer extruded just prior to the manifold system 23.

Figure 3:
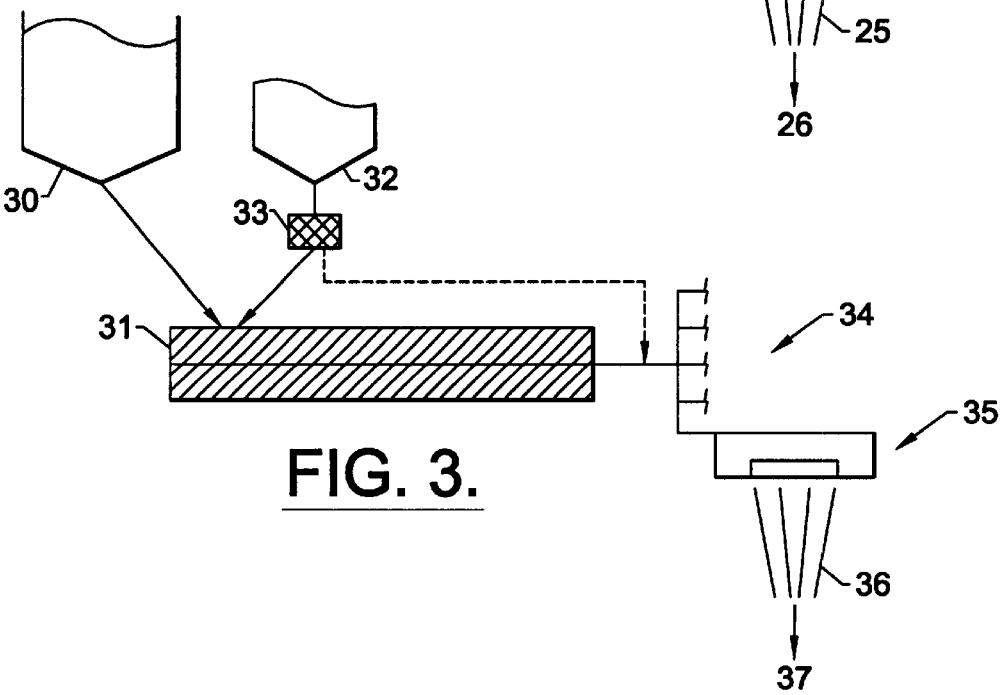
FIG. 3 is a schematic diagram of the liquid color dispersion technology of the present invention.

FIG. 3 illustrates the contrasting method of the present invention. As illustrated therein, the base chip is again taken from a dryer 30 and forwarded directly to the extruder 31. Instead of preparing a masterbatch, however, the method of the invention comprises adding a liquid dispersion 32 of the colorant directly to the base chip polymer either in the extruder or just prior to the manifold system. As FIG. 3 illustrates, the liquid dispersion 32 can be pumped by pump 33 either to the extruder 31 or to a point just prior to the manifold system that is broadly designated at 34. Thereafter, the colored melt phase condensation polymer is spun into filament form using a block, pack, and spinneret broadly designated at 35 from which the filaments 36 are forwarded to appropriate take-up system 37 that typically includes various finishing and packaging steps.

The invention is, of course, similarly useful in direct-coupled continuous polymerization and spinning systems that omit the chip-making and extrusion steps and instead direct the polymerized melt directly to the spinneret. In such cases the liquid dispersion of colorant can be added to a manifold system prior to the spinneret such as is illustrated at 34 in FIG. 3.

Those familiar with the textile arts will recognize that the terms "spinning" and "spun" are typically used to refer to two different processes. In one sense, "spinning" refers to the manufacture of melt phase polymer into filament. In its other sense, "spinning" refers to the process of manufacturing yarns from staple fibers or sliver. Both senses of "spinning" are used herein, and will be easily recognized in context by those of ordinary skill in the art.

In preferred embodiments, the step of adding the liquid dispersion of colorant comprises adding an dispersion in which the liquid is organic, non-aqueous, soluble in polyester, and has a boiling point greater than the melting point of polyester (or other condensation polymer). For use with polyester, the liquid preferably has a boiling point greater than about 300° C. The high boiling point of the dispersion liquid helps avoid generating gas in the polymer stream at the melt viscosity temperatures. As noted above, the condensation polymers that can be colored according to the present invention can include polyethylene terephthalate, polybutylene terephthalate, poly(trimethylene terephthalate), other polyesters, nylon 6, and nylon 66.

The colorant preferably comprises a thermally stable disperse dye or thermally stable pigment, and the combination of colorant and liquid in the dispersion are selected to have good wetting properties with respect to each other.

The following tables illustrate the comparative advantages of the present invention. Table 1 and Table 2 are related in that Table 1 summarizes the more detailed information presented in Table 2. As Table 1 demonstrates, six types of examples of polyester filament that were colored according to the invention using red dye were compared against control standard filaments. The yarns were compared as partially oriented yarn (POY), flat drawn yarn, and draw textured (DTX) yarn. When compared as POY, the Dynafil and $\Delta E_{Lab}$ results were both very favorable. As Table 1 demonstrates, the largest $\Delta E_{Lab}$ was 0.58. Although color comparisons are necessarily somewhat subjective, those familiar with coloring processes are aware that a $\Delta E_{Lab}$ of 1.0 or less is generally considered a very good color match.

With respect to the flat drawn yarn, the breaking strengths are all very similar and indeed the difference is between the standard and the samples according to the invention are almost statistically negligible. Similarly, elongation at break and tenacity for the flat drawn yarn according to the invention is favorably comparable with, and indeed almost identical to, that of standard uncolored yarn.

The draw textured yarn showed similar consistent properties among breaking strength, elongation, and tenacity.

Table 3 shows some properties for yarns colored conventionally rather than according to the present invention. Table 4 compares the data of the conventionally colored yarn of Table 3 with yarn colored according to the present invention of Tables 1 and 2. It will be noted that in each case the pre-aggregate tension (T1) of the yarn formed according to the invention is significantly superior to that of conventionally colored yarn. More importantly, the standard deviation and range of differences from the average is quite small for the liquid matrix technology of the present invention as compared to that for conventionally colored yarns. This uniformity among yarns produced according to the present invention is one of the significant advantages of the present invention in that various types of spinning, weaving and knitting machinery do not need to be continually readjusted to account for the differences in mechanical properties among yarns colored conventionally. Instead, the uniform physical properties in colored yarns offered by the present invention offers the end user the opportunity to use a variety of different colors of the same yarn with the knowledge that the yarn will behave consistently from color to color.

Figure 4:
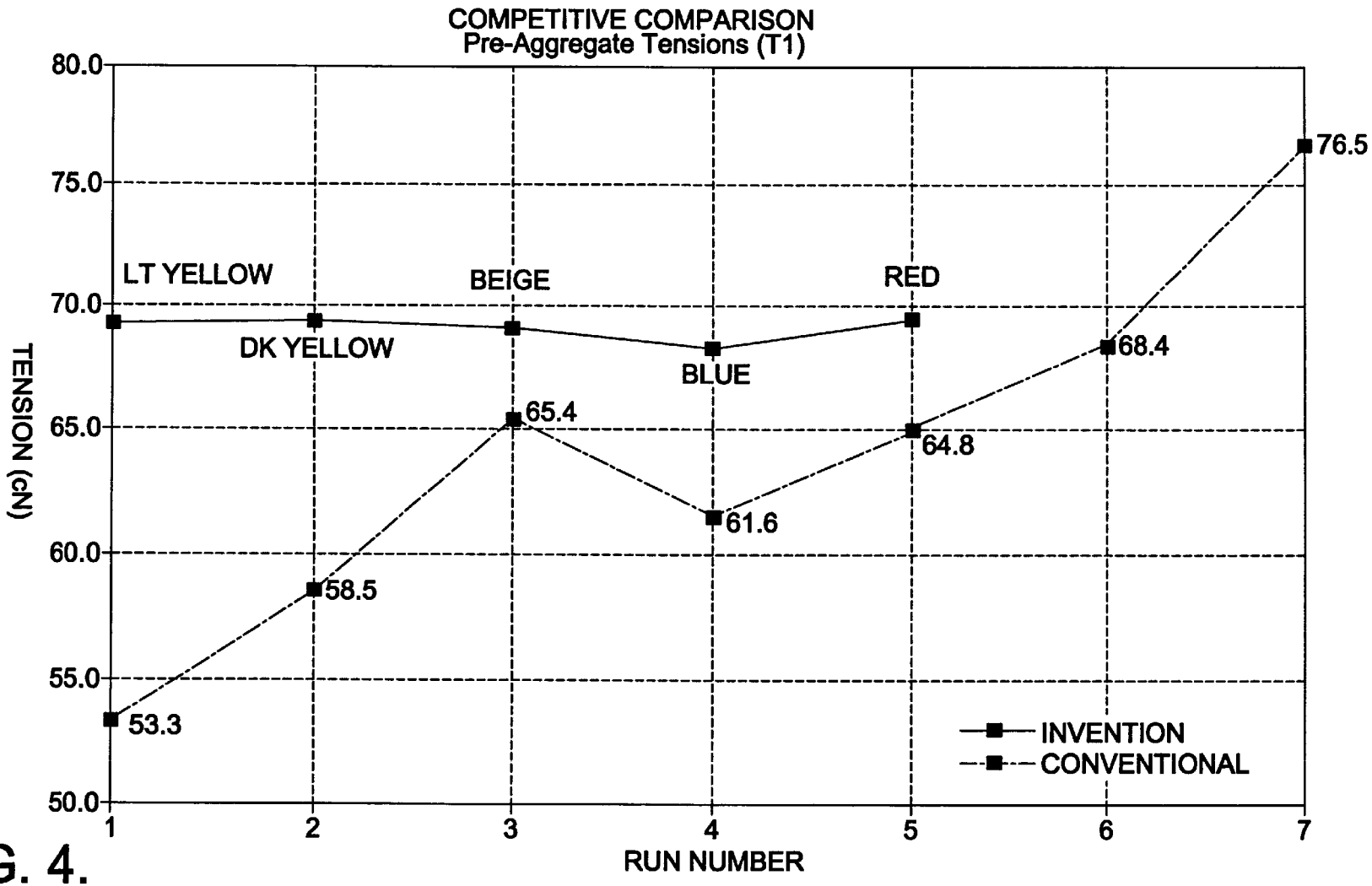
FIG. 4 is a plot of pre-aggregate tensions taken across a plurality of filament samples for filament produced according to the present invention and according to conventional masterbatch processes.

FIGS. 4 through 9 are plots of certain of the data in Tables 1–4. In particular, FIG. 4 plots pre-aggregate tensions for five yarns colored according to the present invention and seven colored conventionally. As FIG. 4 demonstrates, the tensions of yarns according to the present invention are remarkably consistent, while the tensions of the conventionally colored yarns vary over an undesirably wide range.

Figure 5:
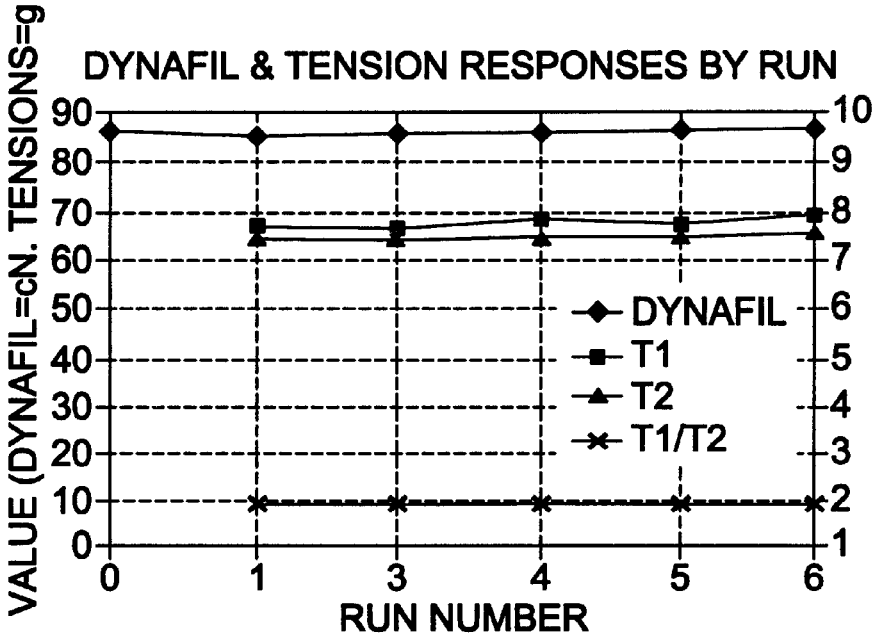
FIG. 5 is a plot of Dynafil and tension responses by run taken across several samples of the present invention.

FIG. 5 shows the consistency in Dynafil measurements, post-aggregate tension, and the ratio of pre- and post-aggregate tensions as well as the consistency in pre-aggregate tension.

Figure 6:
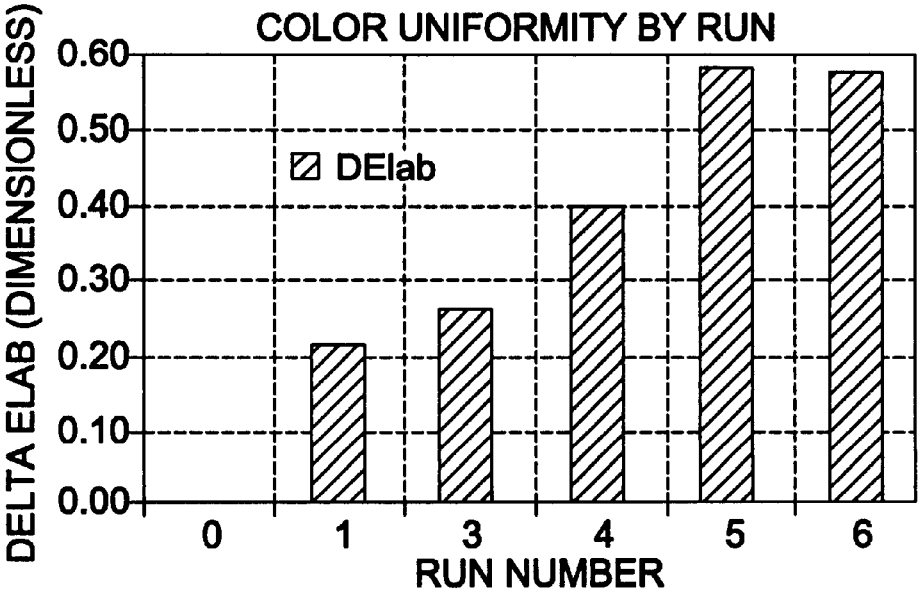
FIG. 6 is a plot of color uniformity taken across several samples of the present invention.
Figure 7:
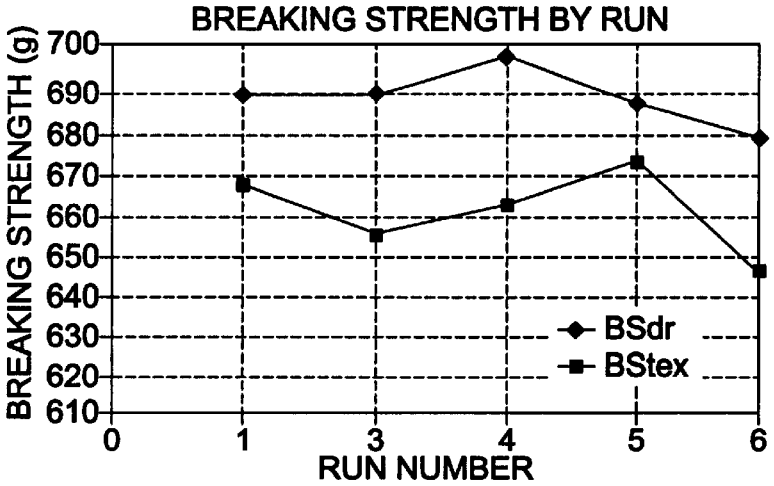
FIG. 7 is a plot of breaking strength taken across several samples of the present invention.
Figure 8:
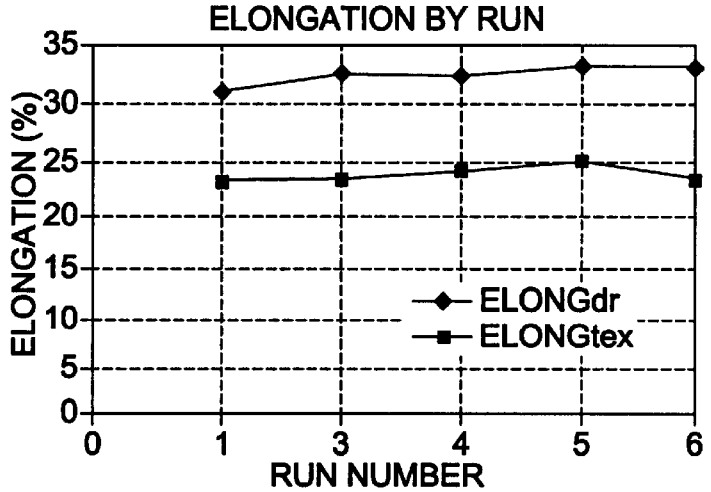
FIG. 8 is a plot of elongation taken across several samples of the present invention.
Figure 9:
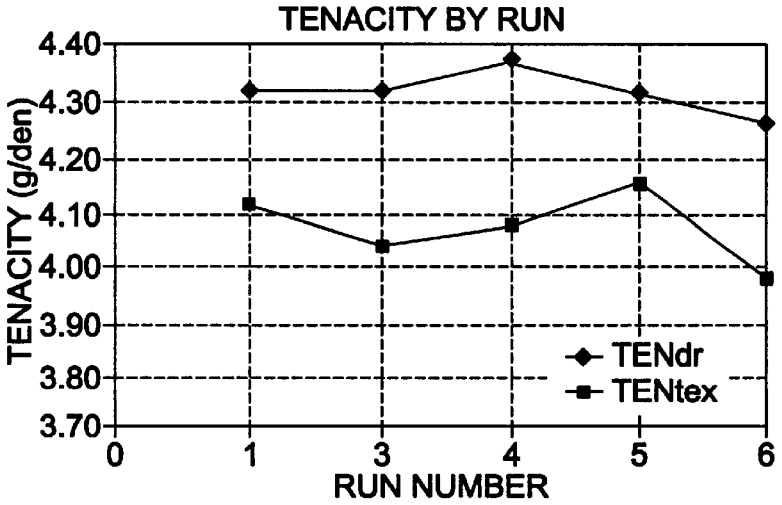
FIG. 9 is a plot of tenacity taken across several samples of the present invention.

FIG. 6 plots the color uniformity data of Table 3. FIGS. 7, 8 and 9 respectively demonstrate the excellent yarn performance in terms of Breaking Strength, Elongation, and Tenacity, all of which are also summarized in the Tables.

TABLE 1

Lot to Lot Uniformity; Summary of Table 2 Six Lots of A single Product (Red) Including Uncolored Standard

| RUN | POY | | FLAT DRAWN YARN | | | DTX YARN | | | | | |
|---|---|---|---|---|---|---|---|---|---|---|---|
| NUMBER | DYNAFIL | E lab | BSdr | ELONGdr | TENdr | BStex | ELONGtex | TENtex | T1 | T2 | T1/T2 |
| STD | 87.00 | | 701.63 | 33.63 | 4.40 | 663.13 | 23.45 | 4.08 | 67.0 | 64.3 | 1.0 |
| 1 | 86.13 | 0.21 | 688.58 | 31.31 | 4.32 | 667.35 | 23.23 | 4.11 | 67.0 | 64.9 | 1.0 |
| 2 | 78.29 | 0.19 | 686.95 | 33.11 | 4.31 | 665.03 | 24.21 | 4.10 | 64.2 | 61.5 | 1.0 |
| 3 | 86.39 | 0.26 | 688.98 | 32.61 | 4.32 | 655.35 | 23.26 | 4.04 | 66.4 | 64.6 | 1.0 |
| 4 | 86.15 | 0.40 | 697.75 | 32.40 | 4.38 | 662.28 | 24.01 | 4.08 | 68.0 | 64.5 | 1.1 |
| 5 | 86.91 | 0.58 | 687.60 | 33.23 | 4.31 | 673.38 | 24.82 | 4.15 | 67.2 | 64.7 | 1.0 |
| 6 | 86.92 | 0.58 | 679.10 | 33.09 | 4.26 | 645.85 | 23.07 | 3.98 | 69.2 | 65.4 | 1.1 |

TABLE 2

Lot to Lot Uniformity Six Lots of Single Product (Red) Per the Invention Includes Uncolored Standard

| RUN | | POY | | FLAT DRAWN YARN | | | DTX YARN | | | | | |
|---|---|---|---|---|---|---|---|---|---|---|---|---|
| NUMBER | | DYNAFIL | E lab | BS | ELONG | TENACITY | BS | ELONG | TENACITY | T1 | T2 | T1/T2 |
| STD | | | | 700.2 | 35.16 | 4.39 | 646 | 24.7 | 3.975 | | | |
| | | | | 706.3 | 33.37 | 4.43 | 706 | 25.0 | 4.345 | | | |
| | | | | 705.0 | 33.17 | 4.42 | 669 | 21.8 | 4.117 | | | |
| | | | | 695.0 | 32.83 | 4.36 | 675 | 22.0 | 4.154 | | | |
| | | | | | | | 658 | 27.2 | 4.049 | | | |
| | | | | | | | 687 | 25.7 | 4.228 | | | |
| | | | | | | | 655 | 22.0 | 4.034 | | | |
| | | | | | | | 609 | 19.2 | 3.748 | | | |
| | AVG | 87 | | 701.6 | 33.63 | 4.40 | 663.13 | 23.45 | 4.08 | | | |
| | STDEV | | | 5.1 | 1.04 | 0.03 | 29.03 | 2.62 | 0.18 | | | |
| | CV | | | 0.7 | 3.10 | 0.73 | 4.38 | 11.18 | 4.38 | | | |
| 1 | | | | 696.1 | 33.97 | 4.364 | 686.0 | 25.36 | 4.228 | | | |
| | | | | 696.4 | 31.55 | 4.366 | 637.3 | 21.38 | 3.925 | | | |
| | | | | 681.3 | 29.66 | 4.272 | 645.1 | 21.09 | 3.973 | | | |
| | | | | 680.5 | 30.04 | 4.266 | 700.4 | 25.08 | 4.313 | | | |
| | AVG | 86.13 | 0.21 | 688.6 | 31.31 | 4.32 | 667.35 | 23.23 | 4.11 | 67 | 64.9 | 1.03 |
| | STDEV | | | 8.9 | 1.96 | 0.06 | 30.88 | 2.31 | 0.19 | | | |
| | CV | | | 1.3 | 6.25 | 1.29 | 4.63 | 9.93 | 4.62 | 2.6 | 5.5 | |
| 2 | | | | 678.8 | 34.17 | 4.256 | 703.2 | 26.59 | 4.33 | | | |
| | | | | 707.5 | 34.2 | 4.436 | 633.8 | 22.77 | 3.903 | | | |
| | | | | 681.3 | 31.92 | 4.272 | 664.7 | 24.59 | 4.093 | | | |
| | | | | 680.2 | 32.15 | 4.265 | 658.4 | 22.9 | 4.054 | | | |
| | AVG | 78.29 | 0.19 | 687.0 | 33.11 | 4.31 | 665.03 | 24.21 | 4.10 | 64.2 | 61.5 | 1.04 |
| | STDEV | | | 13.7 | 1.24 | 0.09 | 28.73 | 1.79 | 0.18 | | | |
| | CV | | | 2.0 | 3.76 | 2.00 | 4.32 | 7.39 | 4.32 | 2.4 | 4.8 | |
| 3 | | | | 652.7 | 32.46 | 4.092 | 678.5 | 24.01 | 4.179 | | | |
| | | | | 699.8 | 32.4 | 4.388 | 610.8 | 20.75 | 3.798 | | | |
| | | | | 690.7 | 31.51 | 4.331 | 643.1 | 23.55 | 3.96 | | | |
| | | | | 712.7 | 34.06 | 4.469 | 683 | 24.72 | 4.206 | | | |
| | AVG | 86.39 | 0.26 | 689.0 | 32.61 | 4.32 | 655.35 | 23.26 | 4.04 | 66.4 | 646 | |
| | STDEV | | | 25.8 | 1.06 | 0.10 | 31.29 | 1.74 | 0.19 | | | |
| | CV | | | 3.7 | 3.25 | 3.75 | 4.77 | 7.48 | 4.78 | 0.9 | 4.1 | |
| 4 | | | | 690.5 | 32.6 | 4.367 | 689.5 | 26.89 | 4.246 | | | |
| | | | | 730.7 | 36.01 | 4.582 | 601.5 | 20.44 | 3.704 | | | |
| | | | | 678.5 | 29.64 | 4.254 | 648.7 | 22.65 | 3.995 | | | |
| | | | | 685.3 | 31.34 | 4.297 | 709.4 | 26.06 | 4.368 | | | |
| | AVG | 86.15 | 0.40 | 697.8 | 32.40 | 4.38 | 662.28 | 24.01 | 4.08 | 68 | 64.5 | 1.05 |
| | STDEV | | | 23.2 | 2.70 | 0.15 | 47.75 | 3.01 | 0.29 | | | |
| | CV | | | 3.3 | 8.32 | 3.33 | 7.21 | 12.52 | 7.21 | 2 | 6 | |
| 5 | | | | 665.1 | 32.14 | 4.17 | 716.1 | 26.39 | 4.41 | | | |
| | | | | 720.4 | 36.48 | 4.517 | 614.3 | 21.35 | 3.783 | | | |
| | | | | 665.1 | 30.39 | 4.17 | 671.1 | 24.34 | 4.133 | | | |
| | | | | 699.8 | 33.92 | 4.388 | 692 | 27.21 | 4.261 | | | |
| | AVG | 86.91 | 0.58 | 687.6 | 33.23 | 4.31 | 673.38 | 24.82 | 4.15 | 67.2 | 64.7 | |
| | STDEV | | | 27.3 | 2.60 | 0.17 | 43.46 | 2.61 | 0.27 | | | |
| | CV | | | 4.0 | 7.83 | 3.98 | 6.45 | 10.52 | 6.45 | 0.2 | 4.9 | |
| 6 | | | | 683.5 | 33.82 | 4.285 | 672.7 | 24 | 4.143 | | | |
| | | | | 678.1 | 31.77 | 4.251 | 577.7 | 19.82 | 3.558 | | | |
| | | | | 656.1 | 31.51 | 4.113 | 651.2 | 23.48 | 4.01 | | | |
| | | | | 698.7 | 35.24 | 4.38 | 681.8 | 24.97 | 4.199 | | | |
| | AVG | 86.92 | 0.58 | 679.1 | 33.09 | 4.26 | 645.85 | 23.07 | 3.98 | 69.2 | 65.4 | 1.06 |
| | STDEV | | | 17.6 | 1.77 | 0.11 | 47.21 | 2.25 | 0.29 | | | |
| | CV | | | 2.6 | 5.35 | 2.60 | 7.31 | 9.76 | 7.31 | 1.3 | 4.8 | |

TABLE 3

Seven Lots of a Single Textured Color Produced Using Conventional Technology

| DATE | BS | TENAC | ELONG | T1 | T2 | T2/T1 |
|---|---|---|---|---|---|---|
| unknown | 700.1 | 4.54 | 24.06 | 53.3 | 56.9 | 1.07 |
| 12/15/93 | 666.7 | 4.36 | 25.21 | 58.5 | 60.6 | 1.04 |
| 2/4/94 | 662.9 | 4.36 | 21.01 | 65.4 | 62.2 | 0.95 |
| 5/13/94 | 716.3 | 4.66 | 26.11 | 61.6 | 65.8 | 1.07 |
| 7/20/94 | 714.5 | 4.63 | 22.99 | 64.8 | 69.5 | 1.07 |
| 7/13/95 | 722.5 | 4.68 | 23.45 | 68.4 | 74.0 | 1.08 |
| 5/10/96 | 679.7 | 4.34 | 24.13 | 76.5 | 78.1 | 1.02 |

TABLE 4

Five Colors Produced per the Invention and Seven Lots of a Single Color Prodnced Conventionally

| INVENTION | | CONVENTIONAL | |
|---|---|---|---|
| SAMPLE | TENSION | SAMPLE | TENSION |
| lt yellow | 69.4 | 1 | 53.3 |
| dk yellow | 69.4 | 2 | 58.5 |
| beige | 69.2 | 3 | 65.4 |
| blue | 68.3 | 4 | 61.6 |
| red | 69.5 | 5 | 64.8 |
| | | 6 | 68.4 |

TABLE 4-continued

Five Colors Produced per the Invention and Seven Lots of a Single Color Prodnced Conventionally

| INVENTION | | CONVENTIONAL | |
|---|---|---|---|
| SAMPLE | TENSION | SAMPLE | TENSION |
| | | 7 | 76.5 |
| avg | 69.2 | Avg | 64.1 |
| std dev | 0.5 | std dev | 7.4 |
| cv | 0.7 | Cv | 11.6 |

TABLE 5

Six Lots of Single Product per Invention as Compared to Seven Lots of Single Product per Conventional Technology

| | INVENTION | | | Conventional | | |
|---|---|---|---|---|---|---|
| RUN | BS | ELONG | T1 | BS | ELONG | T1 |
| 1 | 667.35 | 23.23 | 67.0 | 700.1 | 24.06 | 53.3 |
| 2 | 665.03 | 24.21 | 64.2 | 666.7 | 25.21 | 58.5 |
| 3 | 655.35 | 23.26 | 66.4 | 662.9 | 21.01 | 65.4 |
| 4 | 662.28 | 24.01 | 68.0 | 716.3 | 26.11 | 61.6 |
| 5 | 673.38 | 24.82 | 67.2 | 714.5 | 22.99 | 64.8 |
| 6 | 645.85 | 23.07 | 69.2 | 722.5 | 23.45 | 68.4 |
| 7 | | | | 679.7 | 24.13 | 76.5 |
| avg | 661.5 | 23.8 | 67.0 | 694.7 | 21.0 | 64.1 |
| std dev | 9.7 | 0.7 | 1.7 | 24.8 | 8.1 | 7.4 |
| cv | 1.5 | 2.9 | 2.5 | 3.6 | 3.9 | 11.6 |

TABLE 6

Comparison of Control and Invention-Dyed Nylon 6 Fiber

| Yarn | Control | | | Invention | | |
|---|---|---|---|---|---|---|
| Type | Denier | Elongation | Tenacity | Denier | Elongation | Tenacity |
| Spun | 240 | 107.3 | 2.4 | 240 | 107.3 | 2.5 |
| Drawn | 120 | 18.4 | 6.2 | 120 | 19.5 | 6.2 |

The application to another polycondensation polymer, nylon 6, was demonstrated (Table 6). Yarns were spun at 2000 mpm to produce a 240 denier yarn with 34 filaments. These were subsequently drawn at 150 degrees C. with a draw ratio of 2.00. Results contrasting the unmodified control with the invention, produced using 0.30% add-on of an olive color, are given in Table 6. No processing difficulties were encountered as a result of the addition of the color, and it is readily observed that there are no significant differences between the nominal fiber properties.

In the most preferred embodiments, the liquid dispersion (also referred to as a "liquid matrix") is that available from Colormatrix Corporation, 3005 Chester Avenue, Cleveland, Ohio 44114 and designated as Colormatrix LCPY-1: 82–89 Series. According to the material safety data sheet (MSDS) from Colormatrix Corporation, the preferred embodiment comprises various oils, esters, pigments and dyes of which the main named ingredient is refined hydrocarbon oil with various non-toxic pigments and dyes. According to the MSDS, the product does not contain reportable hazardous ingredients as defined by the OSHA hazard communication standard (29 CFR 1910.1200). The preferred liquid has a boiling range at atmospheric pressure of at least about 500° F., negligible vapor pressure under the same conditions, a specific gravity of between about 8 and 18 lbs per gallon and is insoluble in water. The liquid is chemically stable and hazardous polymerization does not occur. The liquid is non-corrosive with respect to metals, but is an oxidizer. The product is considered as an "oil" under the Clean Water Act. The product does not contain any toxic chemicals that would be subject to the reporting requirements of SARA Title III Section 313 and 40 CFR Part 372.

In another embodiment, the invention comprises the resulting polyester filament that includes polyethylene terephthalate, the coloring agent, and the non-aqueous organic liquid. One of the advantages of the present invention is that the resulting filament is essentially identical in its physical properties to uncolored polyester (or other condensation polymer) filament. Thus, from the end-user's standpoint, the filament properties are advantageously consistent with those of other polyesters, and indeed more consistent that those of polyester filaments colored using masterbatch processes.

Nevertheless, the filament does contain the non-aqueous organic liquid from the original liquid dispersion. The liquid's nature is such that it remains in the polymer matrix, but otherwise does not interfere with or modify the polymer chain. Accordingly, an appropriate analysis of the filament according to the present invention demonstrates that it includes polyethylene terephthalate, a colorant, and the non-aqueous organic liquid.

In yet another embodiment, the invention comprises staple fiber cut from the filament of the present invention and yarns formed from the cut staple fiber. As with other polyesters, the filament and fiber can be textured and the fiber can be blended with the fibers other than polyethylene terephthalate in otherwise conventional fashion to form fabrics, typically woven or knitted fabrics, from these yarns and fibers.

Although the invention has been explained in relation to its preferred embodiments, it will be understood that various modifications thereof will be become apparent to those skilled in the art upon reading the specification, therefore, it will be understood that the invention disclosed herein covers such modifications as fall within the scope of the appended claims.

That which is claimed is:

1. A polyester filament comprising:

polyethylene terephthalate;

a coloring agent; and a nonaqueous organic refined hydrocarbon oil that is soluble in melt phase polyester, has a boiling point above 300° C. and does not otherwise modify the polyester polymer chain.

2. A polyester filament according to claim 1 wherein said coloring agent comprises a disperse dye.

3. A polyester filament according to claim 1 wherein said coloring agent comprises a pigment.

4. A polyester filament according to claim 1 wherein said nonaqueous organic liquid comprises a refined hydrocarbon oil.

5. A textured polyester filament according to claim 1.

6. A staple fiber cut from the filament of claim 1.

7. A yarn comprising the staple fiber according to claim 6.

8. A yarn according to claim 7 and further comprising a blend of fibers other than polyethylene terephthalate.

9. A fabric comprising yarns according to claim 7.

10. A fabric according to claim 9 selected from the group consisting of woven fabrics and knitted fabrics.

11. A fabric comprising yarns according to claim 8.

12. A fabric according to claim 11 selected from the group consisting of woven fabrics and knitted fabrics.

* * * * *

UNITED STATES PATENT AND TRADEMARK OFFICE

CERTIFICATE OF CORRECTION

PATENT NO. : 6,383,635 B1
DATED : May 7, 2002
INVENTOR(S) : King et al.

It is certified that error appears in the above-identified patent and that said Letters Patent is hereby corrected as shown below:

Title page,
Item [63], Related U.S. Application Data, add:
-- Related U.S. Application Data
Divisional of Serial No. 08/929, 831 filed September 15, 1997, now U.S. Patent No. 6,110,405 --
Item [56], References Cited, U.S. PATENT DOCUMENTS, delete "5,308, 935" and insert therefor -- 5,308,395 --.

Signed and Sealed this

Fourth Day of January, 2005

JON W. DUDAS
*Director of the United States Patent and Trademark Office*